US005207777A

United States Patent [19]

Shibuya et al.

[11] Patent Number: 5,207,777

[45] Date of Patent: May 4, 1993

[54] APPARATUS FOR TRANSFERRING RAPIDLY QUENCHED METALLIC TAPES

[75] Inventors: Kiyoshi Shibuya; Toru Sato; Nobuyuki Morito; Seiko Nara; Teruo Hiramatsu, all of Chiba, Japan

[73] Assignee: Kawasaki Steel Corporation, Kobe, Japan

[21] Appl. No.: 886,305

[22] Filed: May 21, 1992

Related U.S. Application Data

[63] Continuation of Ser. No. 649,302, Jan. 30, 1991, abandoned, which is a continuation of Ser. No. 422,776, Oct. 17, 1989, abandoned.

[30] Foreign Application Priority Data

| | | | |
|---|---|---|---|
| Oct. 21, 1988 | [JP] | Japan | 63-264215 |
| Oct. 21, 1988 | [JP] | Japan | 63-264216 |
| Nov. 16, 1988 | [JP] | Japan | 63-2875519 |
| Aug. 18, 1989 | [JP] | Japan | 1-211420 |

[51] Int. Cl.[5] ..... B22D 11/06

[52] U.S. Cl. ..... 164/463; 164/477; 164/423

[58] Field of Search ..... 164/463, 479, 477, 423, 164/429, 417

[56] References Cited

FOREIGN PATENT DOCUMENTS 60-87958 5/1985 Japan ..... 164/463

*Primary Examiner*—Kuang Y. Lin

*Attorney, Agent, or Firm*—Dvorak and Traub

[57] ABSTRACT

A method of guiding and transferring a rapidly quenched metallic tape includes steps of peeling the rapidly quenched metallic tape produced by solidification through rapid quenching on a circumferential surface of a single cooling roll rotating at a high speed, introducing the metallic tape into a cylindrical transfer guide to a pinch roll unit arranged at a terminal end of the transfer guide to catch the metallic tape by the pinch roll unit, and moving the pinch roll unit to a winder for the metal tape. The metallic tape is fed in the transfer guide substantially without being in contact with the transfer guide. An apparatus for guiding and transferring a rapidly quenched metallic tape includes a cylindrical transfer guide arranged on a normal line of a single cooling roll for introducing and guiding the metallic tape, a pinch roll unit arranged at a terminal end of the transfer guide for catching the metallic tape, and a transfer trolley for transferring the pinch roll unit to a winder for the metallic tape.

7 Claims, 6 Drawing Sheets

Air Flow Rate at a - Position(m/sec)

Air Flow Rate at β-Position (m/sec)

Air Flow Rate at γ - Position (m/sec)

APPARATUS FOR TRANSFERRING RAPIDLY QUENCHED METALLIC TAPES

This application is a continuation of application Ser. No. 07/649,302 filed Jan. 30, 1991, which is a continuation of application Ser. No. 07/422,776, filed Oct. 17, 1989, both now abandoned.

BACKGROUND OF THE INVENTION

1. Field of the Invention

This invention relates to a method and an apparatus for guiding and transferring a rapidly quenched metallic tape (referred to "tape" hereinafter), particularly an amorphous metallic tape produced by a single roll method from a single cooling roll (referred to "cooling roll" hereinafter) to a winder.

2. Related Art Statement

Recently, it has been investigated and developed to produce metallic tapes directly from molten metals (including alloys) by rapidly liquid quenching methods such as a single roll method and a twin roll method. In carrying out these methods, the producing technique itself may of course be important to determine surface configurations and uniformity in thickness of the metallic tapes. However, in the production of the metallic tapes on industrial scale, it is needed to accomplish handling of produced metallic tapes or technique for winding the metallic tapes into coils.

In case of crystalline metallic tapes having thickness of not less than 100 μm, feeding speeds of the tapes are usually not more than 5 m/sec by a limitation resulting from solidification due to heat transfer to a cooling element. Therefore, such metallic tapes can be transferred by a mesh belt having a clamper and taken up by winding by a heat-resistant belt wrapper as proposed in Japanese Patent laid open No. 61-88,904.

In case of amorphous metallic tapes, on the other hand, the thickness is very thin as less than 50 μm and the feeding speed of the tapes is not lower than 20 m/sec. Therefore, means disclosed in the above Japanese Publication could not be applied without any modifications. With the amorphous metallic tapes, moreover, the characteristics of the materials tend to change depending upon producing speeds so that mechanical strengths are often spoilt. Therefore, it is more difficult to accomplish taking-up technique because the producing speed could not be changed in taking up on a reel and taking off.

It has been proposed to wind an amorphous metallic tape onto a take-up reel having a magnet embedded therein arranged closely adjacent a cooling roll in Japanese Patent laid open No. 57-94,453 and Japanese Patent Application Publication No. 59-34,467. This method is dexterous in arranging the take-up reel closely adjacent the cooling roll to eliminate the troublesome transferring of the tapes. However, as the reel is close to the cooling roll, it is not necessarily suitable for continuous production of the tapes. Moreover, it is not suitable for industrial production on a large scale, for lack of spaces for providing inspection devices for thicknesses and apertures of tapes and control device for tensile forces on the tapes.

In order to avoid these disadvantages, proposals for positively accomplishing the transfer technique by arranging winders remote from cooling rolls have been disclosed in Japanese Patent laid open Nos. 56-12,257, 59-43,772 and 59-138,572 and Japanese Patent Application No. 62-290,477. In these techniques, it has been proposed to use suction devices, brush rolls or brush solid roll pairs and the like as pinch rolls for catching and transferring amorphous metallic tapes. A stable taking up of amorphous metallic tapes can be realized if amorphous metallic tapes are caught between pinch rolls without being ruptured and given tensile forces required for transferring.

As there are few literatures and data concerning the transferring and taking up techniques after producing amorphous metallic tapes in comparison with producing technique thereof, it is not an easy matter to study all the techniques. The inventors have been investigated and improved the guide and transfer of amorphous metallic tapes peeling and flying from cooling rolls arranged remote from winders on the basis of the acknowledgement that arrangement of winders remote from cooling rolls is basically industrially superior, and they have encountered the following problems.

In the guiding and transferring systems above described, brush-solid roll pairs made of a combination of brush rolls and solid rolls are used as pinch rolls. It has been ascertained that by embracing a amorphous metallic tape between pinch rolls, tensile forces required for transferring is given to the metallic tape.

In guiding a rapidly quenched metallic tape produced by solidification through rapid quenching on a cooling roll to pinch rolls through a transfer guide after the peeling from the cooling roll, the guiding was not very difficult matter by applying particular devices to an air knife and the transfer guide. However, the metallic tape could not be pulled, even if the pinch rolls are pressed together. Therefore, the pinch rolls could not be used as a transfer system by moving the pinch rolls to a winder. Tensile forces required for transferring could not be given to a metallic tape only by transferring the metallic tape peeled from a cooling roll through a transfer guide.

SUMMARY OF THE INVENTION

It is an object of the invention to provide a method and an apparatus for guiding and transferring a rapidly quenched metallic tape by giving tensile forces required for transferring to the winder.

In order to achieve this object, in a method of guiding and transferring a rapidly quenched metallic tape including steps of peeling the rapidly quenched metallic tape produced by solidification through rapid quenching on a circumferential surface of a single cooling roll rotating at a high speed, introducing the metallic tape into a cylindrical transfer guide to a pinch roll unit arranged at a terminal end of the transfer guide to catch the metallic tape by the pinch roll unit, and moving the pinch roll unit to a winder for the metallic tape, according to the invention the metallic tape is fed in the transfer guide substantially without being in contact with the transfer guide.

The transfer guide is preferably arranged in a flying direction of the metallic tape peeled from the single cooling roll to feed the metallic tape substantially without being in contact with the transfer guide.

As an apparatus for guiding and transferring a rapidly quenched metallic tape comprising a cylindrical transfer guide for introducing thereinto and guiding therein the rapidly quenched metallic tape produced by solidification through rapidly quenching on a circumferential surface of a single cooling roll and peeled therefrom by an air knife, the transfer guide being arranged on a normal line of the single cooling roll at a position where the metallic tape is peeled, a pinch roll unit arranged at a terminal end of the transfer guide for catching the metallic tape, a blower for increasing air flow rate in a downstream half of the transfer guide, and a transfer trolley for transferring the pinch roll unit and the blower to a winder for the metallic tape, and the transfer guide having at an upper surface an air adjusting plate and at a lower surface a deflector roll.

BRIEF DESCRIPTION OF THE DRAWINGS

The invention will be described with reference to the accompanying drawings, wherein.

DESCRIPTION OF THE PREFERRED EMBODIMENTS

Figure 1:
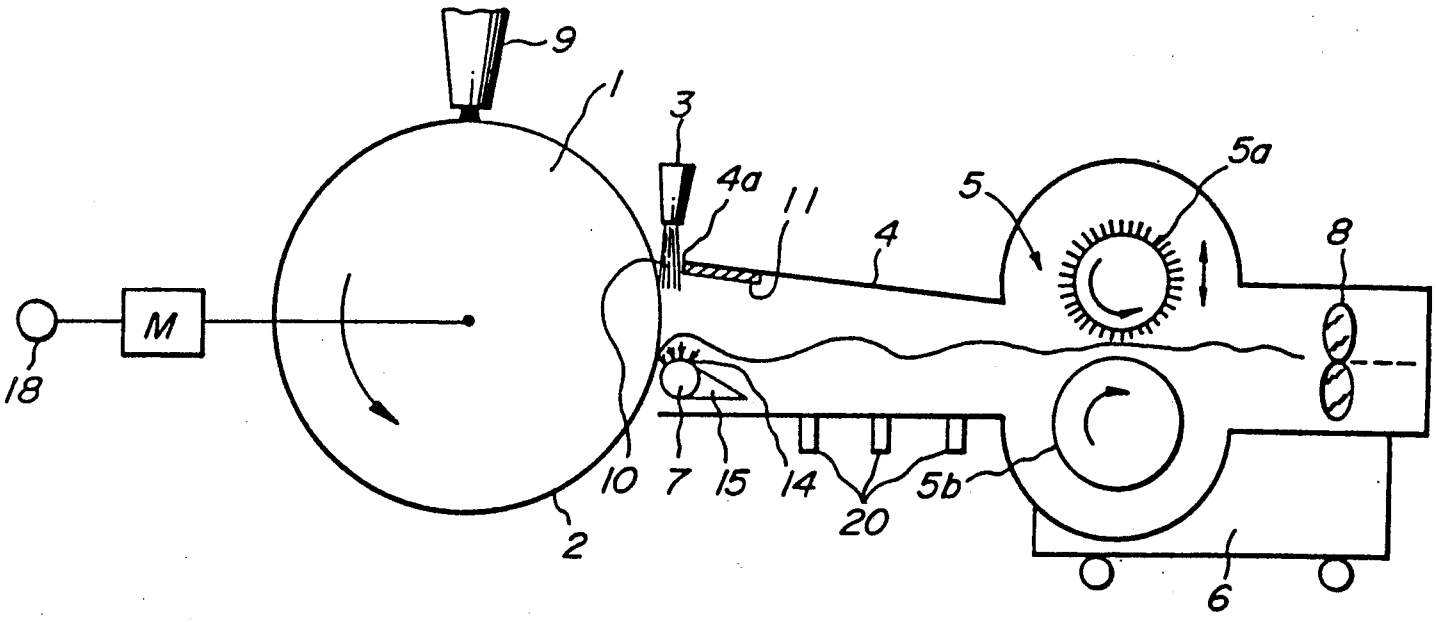
FIG. 1 is a schematic view of an apparatus for guiding and transferring a rapidly quenched metallic tape according to the invention.

In FIG. 1 is shown a preferable apparatus for guiding and transferring the rapidly quenched metallic tape according to the invention, wherein numeral 1 is a cooling roll rotating at a high speed. A metallic tape 2 prepared by solidifying through rapid quenching on the surface of the cooling roll 1 is peeled off from the cooling roll 1 with an air knife 3 and guided into a cylindrical transfer guide 4, at where the tape 2 is caught by a pinch roll unit 5 (combination of brush roll 5*a* and solid roll 5*b*) placed on a transfer trolley 6. Then, the transfer trolley 6 is moved together with the pinch roll unit 5 toward a winder (not shown), whereby the tape 2 is taken up on the winder. Further, a deflector roll 7 is arranged at an entrance side of the transfer guide 4, which functions to form an adequate pas line when tension is applied to the metallic tape. Moreover, a high speed air flow is formed inside the transfer guide 4 by means of a blower 8 arranged behind the pinch roll unit 5. Numeral 9 is a pouring nozzle. The coding roll 1 is rotated by a motor M which is coupled to a tachometer 8. The transfer guide 4 is monitored by speedometer 20. The positions of the speedometer 20 correspond to the measured positions shown in FIG. 4*a*.

In this case, it is important that the transfer guide 4 is arranged so that the axial line of the guide locates on a normal line at a peeling point of the metallic tape 2 from the cooling roll 1, whereby the flying metallic tape 2 is not contacted with the inner wall of the transfer guide 4.

The invention will be described with respect to experimental results leading in the success of the invention.

Figure 2:
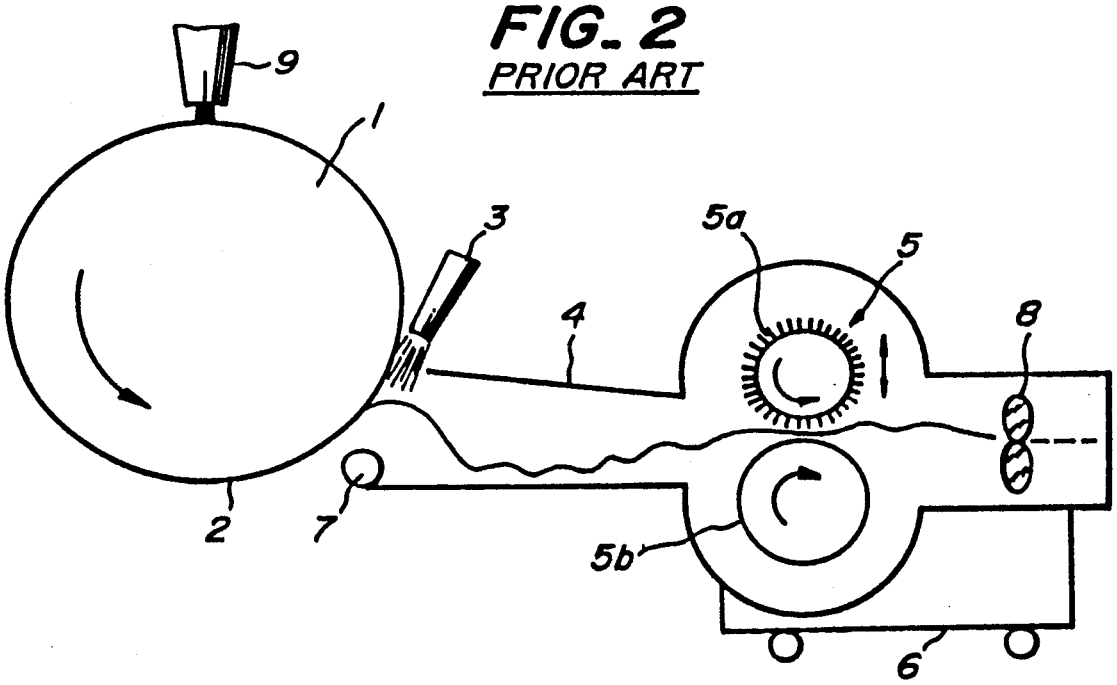
FIG. 2 PRIOR ART
FIG. 2 is a schematic view of the conventional apparatus for guiding and transferring a rapidly quenched metallic tape.

The guiding and transferring of the metallic tape 2 were repeated by using the apparatus shown in FIG. 2. In this apparatus, the transfer guide was shifted from the normal line at the peeling point of the metallic tape without the air adjustment and the optimization of the deflector roll as shown in FIG. 2.

According to the above experiments, the metallic tape 2 could be introduced from the cooling roll 1 through the transfer guide 4 into the entrance side of the pinch roll unit 5, but tension could not be applied to the metallic tape 2. In order to elucidate this cause, the behavior of the metallic tape flying inside the transfer guide was recorded by means of VTR or the like, but in this case, only the continued metallic tape was observed. However, it has been confirmed that if it is intended to cast the metallic tape of amorphous alloy aiming at the invention, since the tape forming rate is usually 25–30 m/sec, an apparently static image can not be obtained by a general picture system, so that the detail movement of the metallic tape can not be analyzed. Now, when the picturing was carried out by making the whole of the apparatus dark and conducting stroboradiation at 1/50000 sec, an apparently static image of the metallic tape flying inside the transfer guide could be recorded by VTR.

When the recorded image is analyzed in detail, there are obtained the following results, which can not quite be anticipated in the conventional VTR observation.

(1) The metallic tape flying inside the transfer guide was raptured in some places;

(2) The cracks were frequently observed in the metallic tape flying inside the transfer guide;

(3) The cracked metallic amorphous tape was easily raptured through the application of tension.

That is, it has newly been found that the occurrence of such a rapture in the transfer guide is a cause of not applying tension to the metallic tape of amorphous alloy through the pinch roll unit.

On the other hand, it is well-known that the mechanical strength of the amorphous alloy tape is very high. When examining the cause of easily generating the crack in such a high strength material inside the transfer guide, there is caused a problem when the metallic tape is passed through the transfer guide. That is, when the metallic tape flying at a high rate of 25–30 m/sec collides with the inner wall face of the guide, the cracks are generated or the tape is broken. This is considered to result from such a characteristic of the amorphous metallic tape that the tape is strong to uniaxial tension but is weak to shearing force.

In order to solve this problem, according to the invention, when the metallic tape peeled off from the cooling roll with the air knife flies inside the transfer guide, the tape does not substantially come into contact with the inner wall face of the transfer guide. Particularly, the transfer guide is arranged in a direction that the metallic tape peeled off from the cooling roll with the air knife flies freely, whereby it is avoided to contact the metallic tape flying inside the transfer guide with the inner wall face of the transfer guide to realize the transferring of the metallic tape without impact.

Moreover, when the transfer guide 4 as shown in FIG. 1 is not arranged between the cooling roll and the pinch roll unit, the rapture of the metallic tape by collision is never caused, but the metallic tape can not stably be guided into the pinch roll unit. Therefore, the arrangement of the transfer guide is essential in the invention.

If it is intended to produce the metallic tape by the single roll method, the metallic tape peeled off from the cooling roll with the air knife tends to fly in a direction of a normal line at the peeling position on the roll surface, so that the metallic tape flies as if it springs out from the center of the roll. Therefore, when the transfer guide is arranged in such a direction, the metallic tape is hardly subjected to impact by contacting with the inner wall face of the guide, and consequently there is caused no cracking nor rapture of the metallic tape.

Further, a distance (width) of a clearance 10 can be adjusted by an adjusting plate 11 arranged on an upper edge portion of an inlet port 4*a* of the transfer guide 4 and freely moved to the cooling roll 1, whereby the width of air flow passage is increased or decreased to change a blowing amount of air to the metallic tape 2 to thereby control the flying direction of the metallic tape 2.

Further, the inventors have examined the influence of air flow inside the transfer guide 4 on the flying trajectory of the metallic tape 2 flying at high speed inside the transfer guide and found the following knowledges.

That is, when air flow is jetted from the air knife 3 under a pressure enough to peel off the metallic tape 2, the air flow in the vicinity of the inlet port of the transfer guide does not advance toward the pinch roll unit in the transfer guide but flows downward toward the bottom face inside the transfer guide. Therefore, the metallic tape 2 peeled off from the cooling roll 1 collides with the bottom face of the inner wall of the transfer guide under an influence of such a downward air flow and then takes a flying trajectory in horizontal direction together with air flow gradually directing toward the pinch roll unit inside the transfer guide.

It is possible to avoid the collision of the metallic tape 2 with the inner wall of the transfer guide 4 to a certain extent by weakening the air flow from the air knife 3. However, the air knife 3 acts to give a pressure enough to completely peel the metallic tape 2, so that there is a restriction for reducing the quantity and pressure of the air flow.

On the other hand, it is difficult to coincide the jetting direction of air from the air knife with the direction of the air flow inside the transfer guide (direction toward pinch roll unit) in view of the structure.

As a result that the flying trajectory of the metallic tape 2 is analyzed from the image of VTR, it has been confirmed that if the air flow from the air knife 3 contacts with the flying metallic tape over a wide area, the trajectory of the tape 2 directs downward to collide with the inner wall of the transfer guide.

In other words, it has been found that it is possible to control the advancing direction of the metallic tape by adjusting the contacting area of air flow from the air knife 3 with the tape 2.

In order to realize such a control, it is advantageous to freely change the width of the air flow from the air knife 3.

Figure 3:
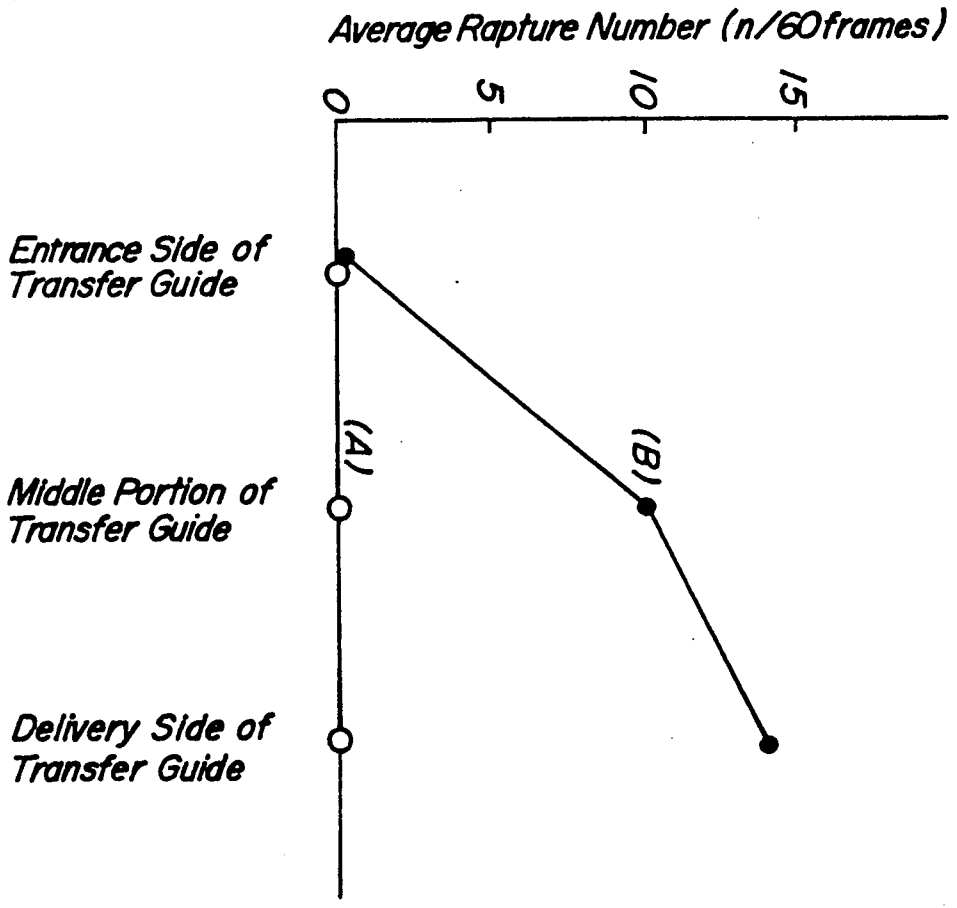
FIG. 3 is a graph showing a relation between flying direction and rapture of metallic tape.

FIG. 3 shows the rapture number of the metallic tape inside the transfer guide (A) when the clearance between the transfer guide 4 and the cooling roll 1 is narrowed to direct the tape toward the pinch roll unit and (B) when the clearance is widened to direct the tape toward the bottom face of the guide.

As seen from the results of FIG. 3, the metallic tape 2 can be guided into the pinch roll unit 5 by adjusting the clearance between the transfer guide 4 and the cooling roll 1 without rapturing the tape inside the transfer guide.

Moreover, the optimum value of the clearance 10 between the transfer guide 4 and the cooling roll 1 is desirable to be determined by confirming the flying trajectory of the metallic tape because this value is varied by physical adhesion force between the tape 2 and the cooling roll 1, suction force at the inlet of the transfer guide 4, relative arrangement between the peeling position of the tape and the clearance 10 and the like.

There may be caused a case that the flying posture of the metallic tape 2 just after the peeling does not necessarily take the horizontal flying trajectory. In this case, it is sufficient to change the distance of the clearance 10 in the widthwise direction of the metallic tape.

In addition, a high speed air flow is formed inside the transfer guide 4 by suction of air through the blower 8 arranged behind the pinch roll unit 5. In this case, it is important that the flow rate of the high speed air flow inside the transfer guide 4 is measured by means of a flow meter (not shown), while the tape passing rate of the metallic tape 2 is measured by means of a tachometer (not shown) based on the rotating rate of the cooling roll 1, whereby the flow rate of the high speed air flow is set above the measured tape feeding speed.

Such a flow rate of the high speed air flow inside the transfer guide 4 can be adjusted and set to a given value by changing at least one of suction amount of the blower 8, air jetting quantity of the air knife 3, clearance 10 between the cooling roll 1 and the transfer guide 4 and inner shape of the transfer guide 4.

In this connection, it has been found that the collision of the metallic tape with the inner wall of the transfer guide can substantially be avoided when the flow rate of the high speed air flow in at least a last half of the transfer guide is made faster than the tape feeding speed of the metallic tape.

Furthermore, the rapture of the rapidly quenched metallic tape on the inner wall face of the transfer guide can be prevented by limiting the length of the transfer guide to a range of 10 cm–100 cm. The reason on such a limitation of the transfer guide length will be described with respect to the following concrete experimental data.

The transfer guide 4 was arranged as shown in FIG. 1, and the length of the transfer guide was varied over a range of 10 cm to 200 cm. While, the high speed air flow of about 35 m/sec was formed inside the transfer guide 4 by means of the blower 8 behind the pinch roll unit 5.

Figure 6:
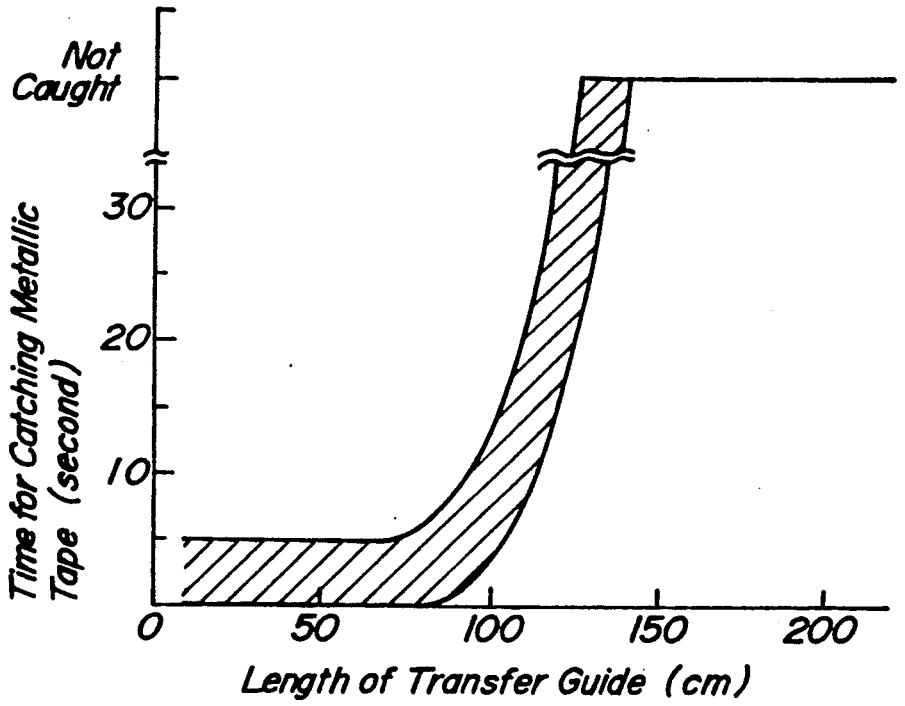
FIG. 6 is a graph showing a relation between length of a transfer guide and time of catching metallic tape.

The amorphous alloy tape peeled off with the air knife 3 was smoothly guided into the transfer guide 4 and caught by the pinch roll unit 5 after the confirmation of passing the tape between the brush roll 5*a* and the solid roll 5*b* constituting the pinch roll unit 5 at an open state, during which the time for catching the tape was measured to obtain results as shown in FIG. 6. As seen from FIG. 6, when the transfer guide length is not more than 100 cm, the catching of the tape is in 10 seconds. If the length exceeds 100 cm, the catching becomes considerably difficult, because it is considered that as the length of the transfer guide becomes long, the probability of rapturing the tape on the inner wall of the transfer guide through collision becomes high. While, when the transfer guide length is less than 10 cm, the high speed air flow required for the catching through the pinch roll unit 5 can not stably be formed.

According to the invention, the metallic tape peeled off from the cooling roll is passed through the transfer guide to the pinch roll unit at substantially non-contact state to the inner wall of the transfer guide by means of a deflector roll having a function as an air floater located at the entrance side of the transfer guide. For this end, the deflector roll is arranged at the entrance side of the transfer guide at such a certain space upward from the bottom of the transfer guide that air sufficiently passes between the deflector roll and the bottom of the transfer guide so as not to disturb the air flow required for controlling the flying posture of the metallic tape flying inside the transfer guide.

The deflector roll is constructed so as to make constant the formation of pass line between the peeling point from the cooling roll and the pinch roll unit when tension is applied to the metallic tape peeled off from the cooling roll by the action of the pinch roll unit and to serve as an air floater for eliminating the friction with the deflector roll. Furthermore, in order to provide good flying posture of the metallic tape before the catching by the pinch roll unit, there is a space between the deflector roll and the transfer guide that air flow sufficiently flows toward the delivery side of the transfer guide. Moreover, the deflector roll is provided with air jet ports 14 jetting air as an air floater for causing no friction between the pass line of the metallic tape after the catching and the deflector roll. If necessary, an apron (guide plate) 15 smoothly flowing air flow inside the transfer guide may effectively be arranged on the lower face of the deflector roll in order to make the disturbance of air flow inside the transfer guide through the deflector roll.

The deflector roll 7 acts to form an adequate pass line when tension is applied to the caught metallic tape. Particularly, it can be said that the deflector roll 7 is effective to form the adequate pass line when the setting position of the transfer guide 4 changes in the height direction of the cooling roll.

Furthermore, the use of the deflector roll as mentioned above brings about the following unexpected results which have never been observed by VTR:

(1) When the metallic tape is caught by the pinch roll unit, it is straight tensioned between the pinch roll unit and the cooling roll. If the deflector roll is existent therebetween, the pass line of the metallic tape is formed between the deflector roll and the cooling roll, and consequently the stable peeling point can be maintained irrespective of the air flow from the air knife;

(2) The tension is instantly applied to the metallic tape in the catching through the pinch roll unit, but the metallic tape is raptured by the deflector roll immediately thereafter;

(3) The metallic tape is instantly closed to the deflector roll in the catching through the pinch roll unit;

(4) The metallic tape collides with the bottom face of the transfer guide to cause the rapture thereof even after it is separated downward from the deflector roll;

(5) It is frequently observed that the metallic tape flying inside the transfer guide is beaten onto the bottom of the transfer guide in the vicinity of the entrance side thereof by the downward air flow from the air knife.

Thus, the deflector roll is essential to form the pass line between the pinch roll unit and the cooling roll, but brings about the rapture of the metallic tape, which is a cause that tension is not applied to the amorphous alloy tape through the pinch roll unit.

As a result of the investigations on such a cause, it has been found that when the metallic tape caught by the pinch roll unit while applying tension thereto comes into contact with the deflector roll, friction is generated to the metallic tape on the surface of the deflector roll and consequently there is caused a so-called sticking phenomenon that tension is different between the upstream and the downstream about the deflector roll. That is, the difference in the speed of the metallic tape between the upstream and the downstream of the deflector roll is caused to lower the speed at the upstream than the tape feeding speed, whereby the slacking of the tape is caused to collide on the deflector roll.

Such a problem has been completely solved by adapting an air floater comprised of plural air jet ports 14 to the tape-passing face of the deflector roll as a means for solving the sticking.

Although the metallic tape is caught without the rapture through the deflector roll provided with the air floater, a phenomenon that the tape is beaten onto the bottom of the transfer guide immediately after the passing through the deflector roll to cause rapture has further been confirmed by VTR. This is based on the air flow about the deflector roll. That is, air drawn into the transfer guide through the suction force of the blower is lost in the vicinity of the bottom of the transfer guide at the entrance side thereof by the deflector roll, and consequently the metallic tape is subjected to downward force by the air flow from the air knife for peeling the metallic tape.

For this end, a clearance is formed between the deflector roll and the bottom of the transfer guide to form an air flow therebetween. As a result, it has been confirmed that air flowing through the clearance has an air flow rate enough to push the metallic tape upward and cause no rapture. Furthermore, the air flowing through the clearance largely acts to push the posture of the metallic tape flying inside the transfer guide upward at the initial stage between the peeling from the cooling roll and the catching through the pinch roll unit, and consequently the inconvenience of colliding the flying metallic tape onto the bottom of the transfer guide before the catching is considerably improved.

In order to more smoothly flow air through the clearance between the deflector roll and the bottom of the transfer guide, an apron 15 is attached to the deflector roll, which is effective to solve a wavy phenomenon of the metallic tape due to discontinuous tension change.

The following examples are given in illustration of the invention and are not intended as limitations thereof.

EXAMPLE 1

A molten alloy having a composition of 10 atomic (hereinafter referred to as "at %") of B, 9 at % of Si, 1 at % of C and the balance being Fe was kept at 1,300° C., and ejected onto an uppermost portion of a cooling roll made of a copper alloy and rotating at a high speed (25 m/sec) through a slit-like nozzle having a width of 100 mm to produce an amorphous alloy tape of 25 μm in thickness. As shown in FIG. 1, the axis of a transfer guide 4 was substantially directed toward the center of the cooling roll 1. A high speed air flow was formed inside the guide by means of a blower behind a pinch roll unit.

Then the alloy tape was peeled off from the cooling roll with an air knife, and introduced into the transfer guide. While the peeled alloy tape was smoothly guided inside the transfer guide, it was led to an opened state pinch roll unit constituted by a brush roll and a solid roll. After the tape passed between the rolls, it was caught by pressing down the brush roll against the solid roll. The metallic tape flying inside the transfer guide did not contact upper and lower faces and side faces of an inner wall of the transfer guide at least with impact.

In this case, it was confirmed that a stable tension was applied to the amorphous alloy tape flying inside the transfer 9uide by the pinch roll unit under rotation at a speed higher than that of the cooling roll by about 2 m/sec, while the tape was not raptured inside the transfer guide, and that the tape could be transferred by moving the pinch roll unit with use of a transfer truck.

EXAMPLE 2

A molten alloy having a composition of 10 at % of B, 9 at % of Si, 1 at % of C and the balance being Fe was kept at 1,300° C., and ejected onto an uppermost portion of the copper alloy cooling roll rotating at a high speed (25 m/sec) through the slit-like nozzle having a width of 100 mm to produce an amorphous alloy tape of 25 μm in thickness.

Then, the alloy tape was peeled off from the cooling roll with the air knife, and guided into the transfer guide. In order to prevent the alloy tape from sticking against the inner wall of the guide during flying in the guide, the width of an air flow from the air knife was adjusted by advancing or retracting an adjusting plate so that the alloy tape might smoothly fly inside the 9uide at a substantially non-contact state. The alloy tape was guided to the opened state pinch roll unit constituted by the brush roll and the solid roll. After the alloy tape was passed through the rolls, it was caught by pressing down the brush roll against the solid roll. The alloy tape flying inside the transfer guide did not contact the upper and lower faces and the side faces of the inner wall of the transfer guide at least with impact.

In this case, it was confirmed that a stable tension was applied to the amorphous alloy tape by the pinch roll unit under rotation at a speed higher than that of the cooling roll by about 2 m/sec, while the alloy tape flying inside the transfer guide was not raptured in the guide, and that the alloy tape could be transferred by moving the pinch roll unit with the transfer truck.

EXAMPLE 3

A molten alloy having a composition of 10 at % of B, 9 at % of Si, 1 at % of C and the balance being Fe was kept at 1,300° C., and ejected onto an uppermost portion of the copper alloy cooling roll rotating at a high speed (25 m/sec) through the slit-like nozzle having a width of 100 mm to produce an amorphous alloy tape of 25 μm in thickness.

Figure 4A:
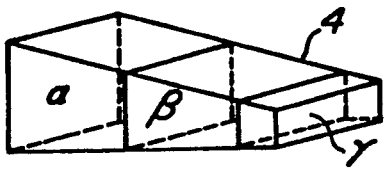
FIGS. 4*a* and 4*d* are views showing a distribution of air flow rate in the transfer guide, respectively.
Figure 4B:
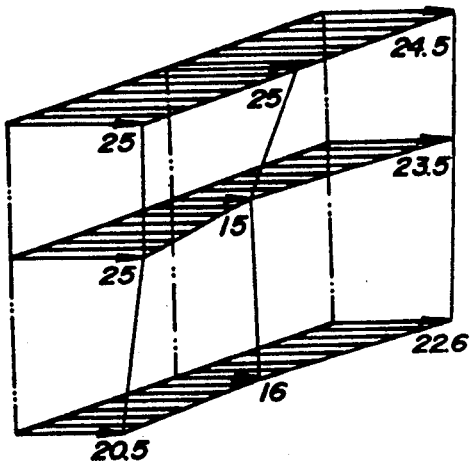
Figure 4C:
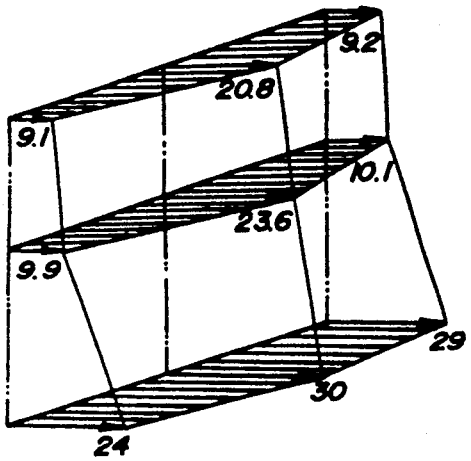
Figure 4D:
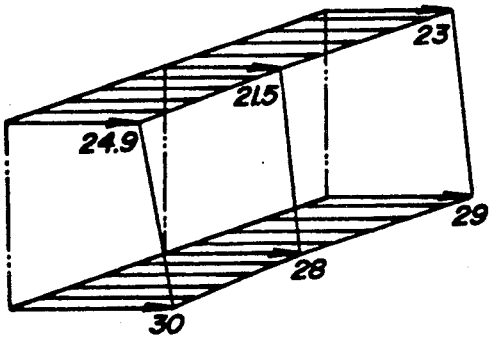

Then, the alloy tape was peeled off from the cooling roll with the air knife by using the apparatus shown in FIG. 1. When the alloy tape was to be guided into the transfer guide, a high speed air flow was preliminarily formed inside the transfer guide by means of the suction blower behind the pinch roll unit as shown in FIGS. 4*a* through 4*d*. FIG. 4*a* shows the shape of the transfer guide and planes at which the flow rate of the air stream was measured. FIGS. 4*b*, 4*c* and 4*d* show flow rates at the planes α, β and γ and respectively, by lengths of arrows and figures (m/s) given thereunder. At that time, the maximum flow rate of the air flow was 30 m/sec at the rear half portion of the transfer guide as shown in FIGS. 4*b* to 4*d*.

The amorphous alloy tape peeled with the air knife was smoothly guided inside the transfer guide. After it was confirmed that the amorphous alloy tape passed through the opened state pinch roll unit constituted by the brush roll and the solid roll, the tape was caught by pressing down lowering the brush roll against the solid roll. The alloy tape flying inside the transfer guide did not contact the upper and lower faces and the side faces of the inner wall of the transfer guide at least with impact. A static image of the alloy tape introduced into the transfer guide was shown at a scale of 1/50,000 in FIG. 5*a*. For the comparison, FIG. 5*b* shows a static image of the alloy tape which contacted the bottom face of the tape transfer guide when the flow rate of the air flow was smaller than that of passing the amorphous alloy tape.

Figure 5A:
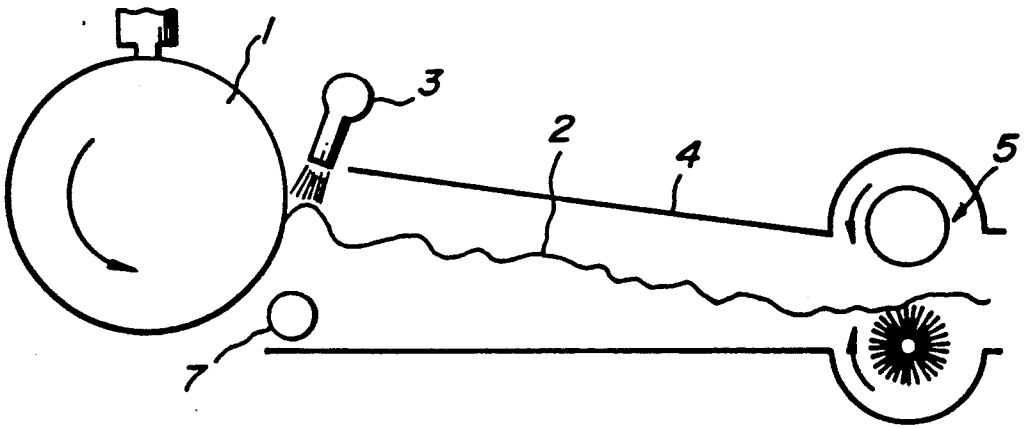
FIGS. 5*a* to 5*b* are views showing an influence of air flow rate in the transfer guide, respectively.
Figure 5B:
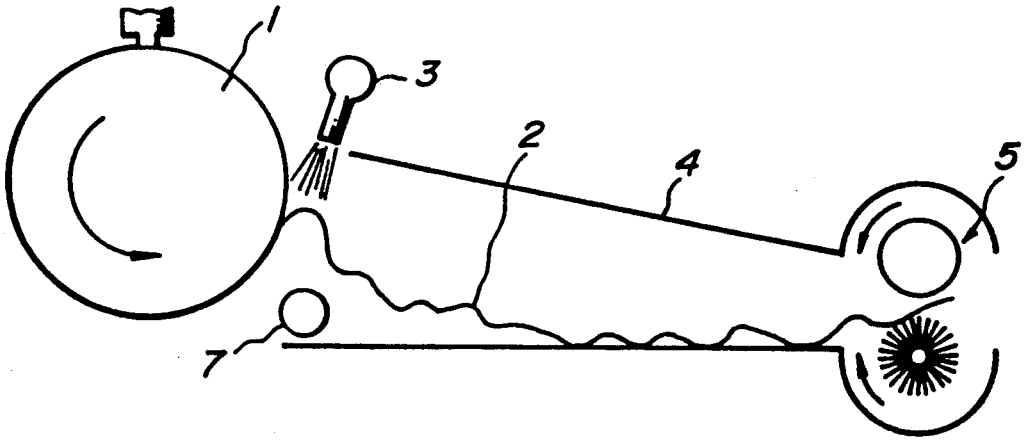

In the case of FIG. 5*a*, it was confirmed that a stable tension was applied to the amorphous alloy tape by the pinch roll unit under rotation at a speed higher than that of the cooling roll is about 2 m/sec, while the tape flying inside the transfer guide was not raptured in the guide, and the the metallic tape could be transferred together with the pinch roll unit by moving the transfer table.

EXAMPLE 4

A molten alloy having a composition of $Fe_{80}B_{10}Si_9Cl$ (at %) was kept at 1,300° C., and ejected onto an uppermost portion of the copper alloy cooling roll rotating at a high speed of 25 m/sec through the slitlike nozzle having a width of 100 mm to produce an amorphous alloy tape of 25 μm in thickness. The transfer guide 4 was arranged as shown in FIG. 1, and had a length of 60 cm. An air flow at a high speed of about 33 m/sec was formed inside the transfer guide 4 by the blower 8 behind the pinch roll unit 5.

The amorphous alloy tape was peeled off with the air knife, and smoothly guided inside the transfer guide. Then, after the tape was passed through the opened state pinch roll constituted by the brush roll and the solid roll, the tape was surely caught within 2 seconds by pressing down the brush roll against the solid roll.

In this case, it was confirmed that a stable tension was applied to the amorphous alloy tape by the pinch roll unit under rotation at a speed higher than that of the cooling roll by about 2 m/sec, while the tape flying inside the transfer guide was not raptured in the guide, and that the tape could be transferred together with the pinch roll unit by moving the transfer trolley.

EXAMPLE 5

A molten alloy having a composition of 10 at % of B, 9 at % of Si, 1 at % of C and the balance being Fe was kept at 1,300° C., and ejected onto an uppermost portion of the copper alloy cooling roll rotating at a high speed of 25 m/sec through the slit-like nozzle having a width of 100 mm to produce an amorphous alloy tape of 25 μm in thickness. As shown in FIG. 1, a deflector roll had air jet ports on the side along which the tape passed, and an air inflow opening was provided between the bottom plate of the transfer guide and the deflector roll. A high speed air flow was formed inside the transfer guide by sucking with the blower behind the pinch roll unit.

Then, the tape was peeled off from the cooling roll with the air knife, and guided to the opened state pinch roll unit constituted by the brush roll and the solid roll. After the tape passed through the pinch roll unit, the tape was caught by pressing down the brush roll against the solid roll. Immediately after the tape was caught, a tension was applied to the flying tape at a stretch so that a pass line was formed between the pinch roll unit and the deflector The tape was guided without rapture, while the pass line was stabilized and the tape did not contact the deflector with impact. Next, it was confirmed that a stable tension was applied to the amorphous alloy tape by the pinch roll unit under rotation at a speed higher than that of the cooling roll by about 2 m/sec, and that the tape could be transferred by moving the pinch roll unit with the transfer table.

As mentioned above, according to the invention, the amorphous alloy tape produced by the single roll method can be transferred and taken up without rapture. Thus, the invention has great significance as a producing technique of metallic tapes.

What is claimed is:

1. An apparatus for guiding and transferring a rapidly quenched metallic tape comprising a cylindrical transfer guide for introducing thereinto and guiding therein the rapidly quenched metallic tape produced by solidification through rapid quenching on a circumferential surface of a single cooling roll and peeled therefrom, said transfer guide being arranged on a normal line of the single cooling roll at a position where the metallic tape is peeled, said transfer guide having upper and lower edges adjacent said single cooling roll and defining clearances with respect to said single cooling roll, a pinch roll unit arranged at a terminal end of the transfer guide for catching the metallic tape, and a transfer trolley for transferring said pinch roll unit to a winder for the metallic tape, said transfer guide is arranged adjacent said single cooling roll, and the apparatus further comprises an air knife for peeling the metallic tape from the single cooling roll by air jetting, said air knife being arranged extending from a downstream side of a rotating direction of the single cooling roll toward said upper clearance between the single cooling roll and the transfer guide, and an adjusting plate on said transfer guide for adjusting the upper clearance between the single cooling roll and the transfer guide.

2. An apparatus as set forth in claim 1, wherein said apparatus further comprises a suction blower arranged downstream of said pinch roll unit for producing high speed air flow in the transfer guide, a tachometer for detecting rotating speeds of the single cooling roll, and a speed meter for detecting velocities of the high speed air flow in the transfer guide.

3. An apparatus as set forth in claim 1, wherein said transfer guide has a length between 10 cm–100 cm.

4. An apparatus as set forth in claim 1, wherein said apparatus further comprises a blower for guiding the metallic tape to the pinch roll unit by suction air produced by the blower, and a deflector roll provided on an entrance side of the transfer guide to form a pass line for the metallic tape, and there is provided a clearance between the deflector roll and a bottom plate of the transfer guide for causing air to flow into the clearance by suction air of the blower.

5. A method of guiding and transferring a rapidly quenched metallic tape which comprises the steps of, peeling a rapidly quenched metallic tape, which is produced by solidification through rapid quenching on a circumferential surface of a single cooling roll rotating at a high speed, jetting air through an upper clearance between the cooling roll and a cylindrical transfer guide, controlling the size of said clearance to adjust the amount of the jetted air against the peeled tape to support and feed the tape to avoid contact with said cylindrical transfer guide, introducing the peeled metallic tape into said transfer guide arranged in a flying direction of the metallic tape to feed the metallic tape substantially without being in contact with the transfer guide, guiding said metallic tape by suction air to a pinch roll arranged at a terminal end of the transfer guide, said suction air being developed by means of a blower, in which high speed air flow directing from an entrance side to a delivery side of the transfer guide is caused by air suction on the delivery side of the transfer guide so that the velocity of the metallic tape fed in the transfer guide, to catch the metallic tape by a pinch roll unit along a pass line substantially formed by a deflector roll with an air floated provided on the entrance side of the transfer guide, and moving the pinch roll unit to a winder for winding the metallic tape.

6. A method as set forth in claim 5 including adjusting the flow rate of the high speed air flow by at least one of adjustments of an amount of the air suction on the delivery side of the transfer guide, and adjusting the amount of the air jetting for peeling the rapidly quenched metallic tape and adjusting the clearance between said cooling roll and the transfer guide.

7. A method of guiding and transferring a rapidly quenched metallic tape, comprising the steps of peeling a rapidly quenched metallic tape from a cooling roll, by directing an air stream through a clearance between an upper edge of a transfer guide and said cooling roll for deflecting said peeled metallic tape upwardly a predetermined amount to define a pass line extending midway through said transfer guide, adjusting the size of said clearance to control the amount of said air stream, directing said peeled metallic tape to a transfer guide by means of air flow, guiding said peeled metallic tape to a pinch roll by means of suction developed at the terminal end of said transfer guide, said suction being higher than the air flow at the entry to said transfer guide, said pinch roll being positioned along said pass line, deflecting said moving metallic tape toward said pinch roll, and moving said pinch roll toward a winder, and winding said metallic tape.

* * * * *